US005442863A

United States Patent [19]

Fazely

[11] Patent Number: 5,442,863

[45] Date of Patent: Aug. 22, 1995

[54] STEREOSCOPIC SIGHTING DEVICE

[76] Inventor: Khosro Fazely, 1256 W. River Rd., Oscoda, Mich. 48750

[21] Appl. No.: 168,934

[22] Filed: Dec. 16, 1993

[51] Int. Cl.[6] ..... F41G 1/00

[52] U.S. Cl. ..... 33/265; 33/257; 33/261; 33/280

[58] Field of Search ..... 33/265, 252, 257, 258, 33/261, 276, 277, 278, 280, 233; 124/87

[56] References Cited

U.S. PATENT DOCUMENTS

| | | | |
|---|---|---|---|
| 1,205,756 | 11/1916 | Le Baron . | |
| 1,476,884 | 12/1923 | Gregory . | |
| 1,818,381 | 8/1931 | Caruth | 33/261 |
| 2,386,420 | 10/1945 | Bailey et al. . | |
| 2,482,822 | 9/1949 | Zaroodny . | |
| 2,866,268 | 12/1958 | Collins . | |
| 3,875,654 | 4/1975 | Davidson | 33/265 |
| 3,886,667 | 6/1975 | Rueb | 33/233 |
| 4,244,115 | 1/1981 | Waldorf | 33/261 |
| 4,385,448 | 5/1983 | Burkey | 33/265 |
| 4,565,009 | 1/1986 | Porter | 33/233 |
| 5,151,310 | 11/1992 | Stoot | 33/265 |

*Primary Examiner*—Alvin Wirthlin

*Attorney, Agent, or Firm*—Reising, Ethington, Barnard & Perry

[57] ABSTRACT

Stereoscopic sighting apparatus includes a support plate supporting a pair of sighting members of identical open loop configuration in laterally spaced side-by-side relation to one another at a distance approximating the spacing between a users eyes for generating an overlapping coincident central image of the sighting member when viewing a distant target with both eyes open. A plurality of distance indicator pairs are supported by the sighting members for enabling the user to compensate for distance to target. The sighting members and distance indicators provide an unobstructed view of the target in the coincident central image while maintaining accuracy. Side-mount mounting hardware enables the apparatus to be mounted to a longitudinal midsection of a bow.

29 Claims, 2 Drawing Sheets

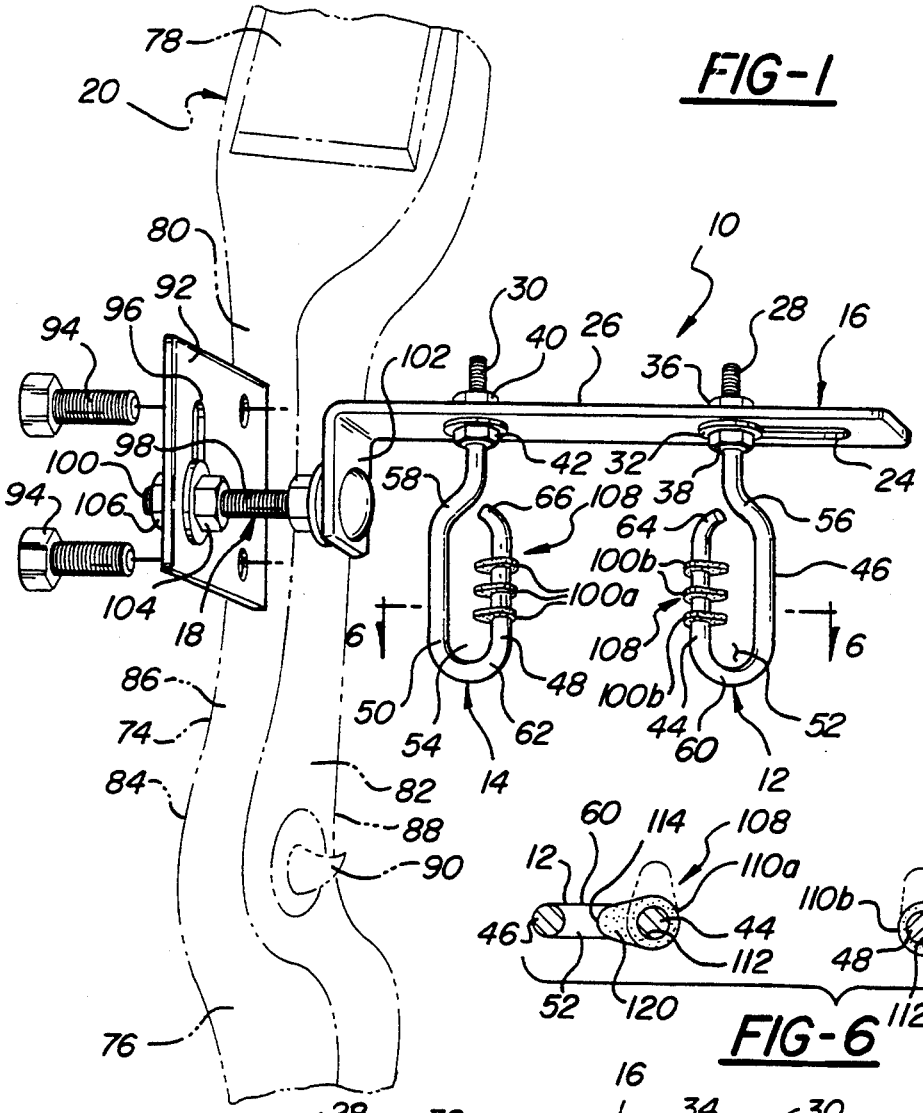
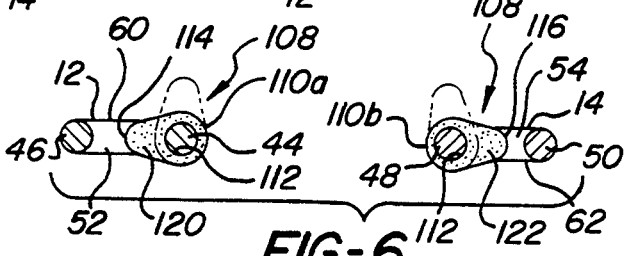
FIG-6
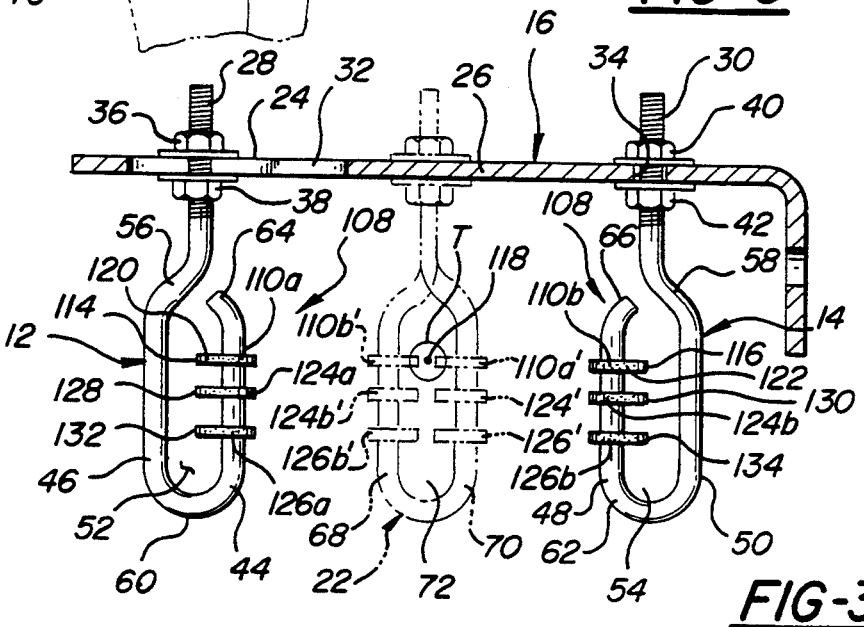
FIG-3

FIG-4
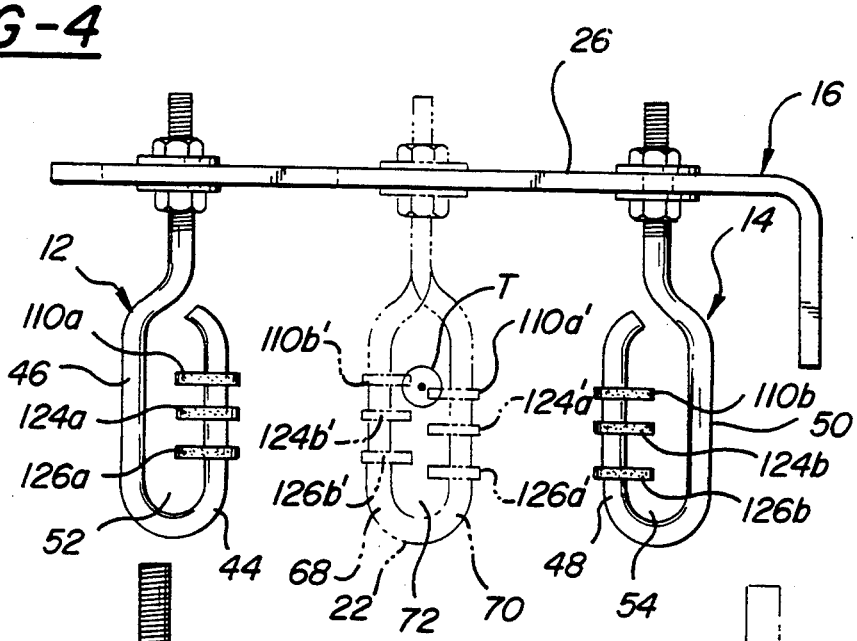
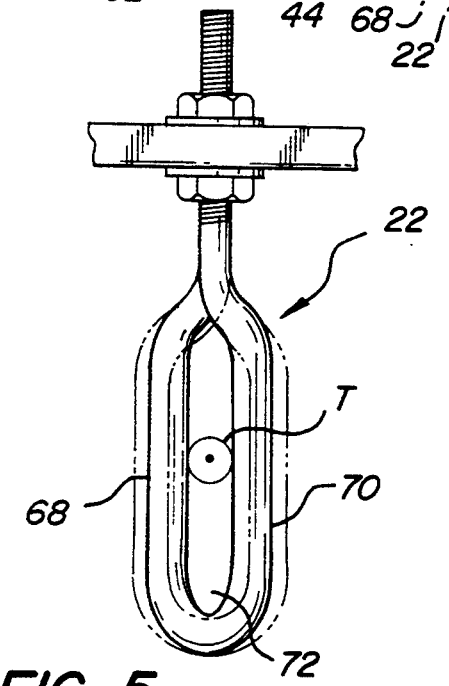
FIG-5
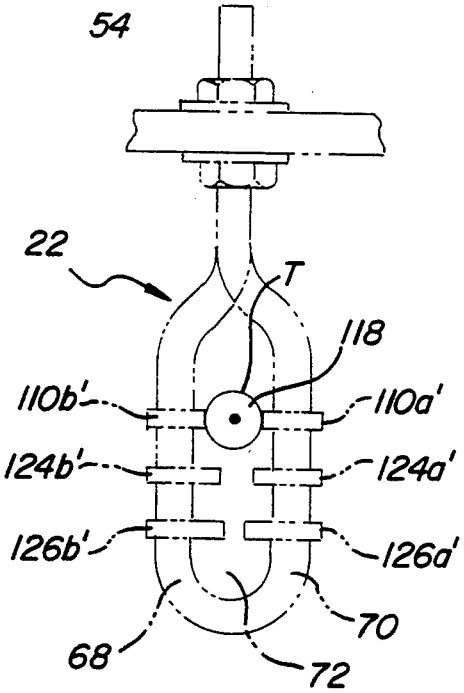
FIG-7
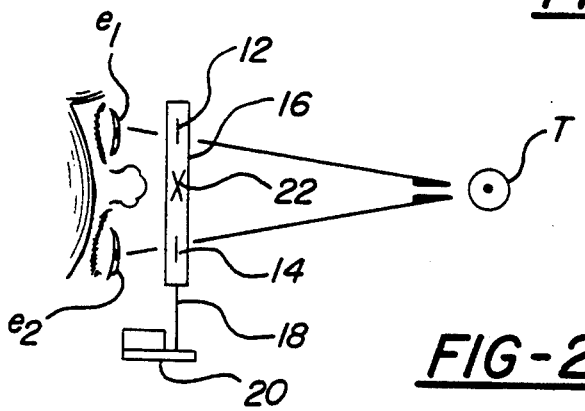
FIG-2

STEREOSCOPIC SIGHTING DEVICE

TECHNICAL FIELD

This invention relates to sighting apparatus and more particularly to stereoscopic sighting apparatus for sighting weapons.

Numerous sighting devices have been developed and are available for sighting weapons, such as firearms and bows for accurate alignment with a distant target.

So-called stereoscopic sighting devices have been developed in the past, as exemplified in U.S. Pat. Nos. 1,476,884 to Gregory, granted Dec. 11, 1923, and 4,565,009 to Porter, granted Jan. 21, 1986. Such devices include a pair of laterally spaced sighting members which, when placed along the users line of sight to a distant target generate a coincident central image of the sighting members in line with the target. The general acceptance of such stereoscopic sighting devices is believed to depend, at least in part, on the users ability to readily perceive the central image and further the ability to make appropriate adjustments to the position of the weapon to compensate for distance to target, particularly when used in accurately sighting bows. The device of Gregory supports the sighting members in such manner as to generate a perceived cross hair effect of the members in the central image and relies on the users ability to perceive a shifting in the cross hair location to compensate for varying distance to target. Such compensation by shifting does not take into account varying trajectory of the projectile fired by different weapons. The device of Porter generates a similar cross hair effect of the sighting members and compensates for distance to target by raising or lowering the sighting members relative to a support. Compensation for multiple distances to target for a given position of the sighting members is thus not provided but rather the sighting members must each time be moved either up or down for different distances to target. Such a requirement is impractical when there is uncertainty as to distance a target may be at, such as when hunting game.

As mentioned, the sighting members of both the Gregory and Porter devices are positioned relative to one another to produce an overlapping cross hair image of the members wherein the point at which the images cross corresponds to the exact location at which the target is to be hit, thereby obstructing the users vision of the exact location at which the target is to be hit. As the target gets further and further away, the perceived size of the target decreases and the cross hairs become more obstructive, especially in low light conditions, such as when hunting at dusk or dawn.

The mounting hardware of Gregory and Porter is suitable for mounting the devices on the barrel of a firearm or a blow gun, but would not be suitable for securing the devices to a longitudinal midsection of a bow.

SUMMARY OF INVENTION AND ADVANTAGES

Stereoscopic sighting apparatus according to one aspect of the invention comprises a pair of left and right longitudinally extending sighting members supported by support means and laterally spaced side-by-side relation to one another on a member to be sighted at a distance approximating the space in between a users eyes and along the users line of sight to a distant target for generating a perceived coincident central image of the sighting members aligned with the target when the target is viewed with both eyes open. Distance compensation means are movable longitudinally relative to the sighting members to at least a selected one of a plurality of longitudinal positions corresponding to associated distances to target and perceived by the user in the coincident central image for enabling the user to make appropriate elevational adjustments to the position of the member to be sighted to compensate for distance to target.

The distance compensation means are readily perceived by the user in the coincident image and enables compensative adjustments to be made for distance without necessitating movement of the sighting members thus allowing for multiple distances to be sighted and compensated for for a single position of the sighting members.

According to another aspect of the invention, the stereoscopic sighting apparatus comprises a pair of left and right sighting members of substantially identical open loop configuration each including inner and outer longitudinal leg sections extending transversely of a support member in laterally spaced relation providing respective open spaces between the leg sections. The sighting members are supported on the support member in laterally spaced side-by-side relation to one another at a central distance between the open spaces approximating the spacing between a users eyes such that when the user positions the sighting members along a line of sight to a distant target, the sighting members generate a perceived coincident central image of the sighting members aligned with the target when the target is viewed with both eyes open with the central image including a single pair of laterally spaced leg section images providing an open space target viewing window therebetween. At least a first pair of left and right distance indicators are supported in laterally spaced relation on the left and right sighting members, respectively, by associated ones of the inner and outer leg sections. The indicators are perceived in the central coincident image as distance indicator images supported in side-by-side coplanar relation by the leg section images with adjacent side edges of the indicator images extending beyond the leg section images into the target viewing window. The side edges are spaced laterally from one another defining an unobstructed sighting region therebetween for sighting the target.

The configuration and arrangement of the sighting members and distance indicators enables the user to accurately aim a member on which the apparatus is mounted for one or more distances to target without obstructing the users view of the exact target location. The unobstructed sighting region and viewing window is particularly advantageous in low lighting conditions and for sighting small or very distant targets.

According to still another aspect of the invention, the sighting apparatus comprises stereoscopic sights supported in side-by-side relation by support means at a distance approximating the spacing between a users eyes. Mounting means project laterally from the support means for mounting the support means and sighting members to a longitudinally extending midsection of a bow and supporting the sights in the side-by-side relation laterally outward to a side of the bow along the users line of sight to a distant target for generating a perceived coincident central image of the sighting members aligned with the target when the target is viewed with both eyes open.

Thus, according to this aspect of the invention, a stereoscopic sighting apparatus is provided having mounting means suitable for mounting the apparatus to a bow.

BRIEF DESCRIPTION OF THE DRAWINGS

These and other features and advantages of the invention will become more readily understood and appreciated by those skilled in the art when considered in connection with the following detailed description and drawings, wherein:

FIG. 1 is a perspective view of the sighting apparatus shown mounted on a bow;

FIG. 2 is a schematic top view of the apparatus shown positioned along a users line of sight to a distant target;

FIG. 3 is a view of the apparatus as seen by the user when viewing the target shown with the perceived central image;

FIG. 4 is a view like FIG. 3 but with the apparatus inclined with respect to horizontal;

FIG. 5 is a fragmentary view of the central image of FIG. 3 but without the distance indicators and in two positions of leg section adjustment;

FIG. 6 is a sectional view taken along line 6—6 of FIG. 1; and

FIG. 7 is a fragmentary view of the central image of FIG. 3 but showing the pairs of distance indicator images in different positions of adjustment.

DETAILED DESCRIPTION

Stereoscopic sighting apparatus constructed in accordance with a presently preferred embodiment of the invention is designated in the drawings generally by the reference numeral 10 and comprises a pair of left 12 and right 14 longitudinal stereoscopic sighting members and support means 16 for supporting the sighting members 12, 14 in side-by-side laterally spaced relation to one another at a distance approximating the lateral spacing between a users eyes $e_1$, $e_2$.

Mounting means 18 are provided for mounting the support means 16 and sighting members 12, 14 on a member to be cited, and preferably a bow 20, with the laterally spaced sighting members 12, 14 positioned in the same planar relationship as the users eyes and along the users line of sight to a distant target T (as in FIG. 2) for generating, based on principals of stereoscopy, a perceived coincident central image 22 of the sighting members 12, 14 aligned with the target T when the user views the target with both eyes open. In other words, the support means 16 and mounting means 18 together support the sighting members 12, 14 in the same laterally spaced planar orientation as that of the users eyes when using the bow 20 (or other member to be sighted) between the user and the target T in direct line of sight to the target, as illustrated schematically in FIG. 2, so that when the user focuses on the target with both eyes open, the stereoscopic effect of the users eyes causes the user to perceive a third combined, superimposed overlapping image 22 of the sighting members 12, 14 that lies midway between the left and right sighting members 12, 14 and in line laterally with the target, as illustrated in FIG. 3.

As mentioned, the lateral spacing of the sighting members 12, 14 is about the same as the lateral spacing of the users eyes so as to achieve the superimposition of the sighting members 12, 14 in the central image 22. In use, the sighting members 12, 14 are mounted forwardly of the users eyes between the user and the target, as illustrated in FIG. 2. As such, the required lateral spacing between the sighting members 12, 14 may be somewhat less than the eye spacing, as the line of sight for the users eyes converges toward the target, thereby necessitating the somewhat narrower spacing. The exact spacing required will likely be different for various users and for different members to be sighted 20, since lateral eye spacing varies from person to person as may the forward spacing of the sighting members 12, 14 among different members to be cited. To accommodate such variances in lateral spacing requirements, the apparatus 10 includes lateral adjustment means 24 enabling selective relative lateral adjustment of the sighting members 12, 14 for adjusting the lateral spacing therebetween.

The support means 16 comprises an elongate support plate 26 greater in width than thickness and extending laterally and crosswise to the longitudinal sighting members 12, 14 between opposite ends thereof. As illustrated best in FIG. 3, the sighting members 12, 14 have corresponding shank portions 28, 30 extending through associated openings 32, 34 provided in the support plate 26. At least one of the openings 32 is in the form of an elongate lateral slot 32 extending lengthwise of the support plate 26 and supporting the associated shank 28 of the sighting member 12 for lateral sliding movement along the slot 32 toward or away from the other sighting member 14 to effectuate adjustment in the relative lateral spacing of the sighting members 12, 14. The opening 34 for the other sighting member 14 may also be in the form of a slot that is separate or joined with the slot 32 or, as illustrated in the drawings, the opening 34 may comprise an annular aperture of the same general cross section but slightly larger in size than that of the shank 34 supporting the sighting member 14 against lateral movement relative to the support plate 26.

The sighting members 12, 14 further include a means for locking the sighting member 12, 14 in the selected position of lateral adjustment preventing relative lateral movement of the sighting members 12, 14. The shank 28 that extends through the lateral slot 32 is formed with external screw threads supporting a pair of internally threaded nuts 36, 38 on opposite top and bottom sides of the support plate 26. The nuts 36, 38 may be tightened against a support plate 26 in opposition with one another to secure the sighting member 12 in place on the support plate 26, or may be loosened to permit lateral adjustment of the sighting member 12 relative to the sighting member 14.

The sighting members 12, 14 also include means for adjusting the relative longitudinal positions of the sighting members 12, 14 for accommodating any longitudinal misalignment of the users eyes or tilt angle of the users head causing longitudinal relative displacement of the users eyes. The threaded shank 28 and nuts 36, 38 of the sighting member 12 enables the sighting member 12 to be moved in a longitudinal direction of the sighting members relatively toward or away from the support plate 26 for raising or lowering the sighting member 12 relative to the support plate 26. It is preferable that the other sighting member 14 also be longitudinally adjustable relative to the support plate 26 independently of the adjustability of the longitudinal adjustability of the sighting member 12. For this purpose, the shank 30 of sighting member 14 is similarly provided with external screw threads supporting a pair of internally threaded nuts 40, 42 for adjusting the position of the sighting member 14 in the longitudinal direction of the sighting member relative to the support plate 26 in the same manner as the longitudinal adjustment of the sighting member 12.

The sighting members 12, 14 each have at least one and preferably two longitudinal inner and outer leg sections, designated by the reference numerals 44, 46 and 48, 50 for the sighting members 12, 14, respectively. The inner leg sections 44, 48 are spaced laterally from their respective outer leg sections 46, 50 providing open spaces 52, 54 between the leg section pairs 44, 46 and 48, 50, respectively. The lateral spacing between the center of the open spaces 54, 52 corresponds to the users eye spacing as described previously. The sighting members 12, 14 preferably have identical open-looped configurations formed in part by the leg sections such that when the sighting members 12, 14 are positioned along the users line of sight to the target, as in FIG. 2, the sighting members appear to be directly superimposed upon one another such that the central image 22 appearing between the sighting members 12, 14 is of the same configuration as the individual sighting members 12, 14, as illustrated in FIG. 3.

The leg sections 44, 46 of the left sighting member 12 are at least partially linear along their lengths and extend perpendicularly away from the support plate 26 in the longitudinal direction and are parallel to one another such that the width of the open space 52 is uniform along the length of the inner and outer leg sections 44, 46. The inner and outer leg sections 48, 50 of the right sighting member 14 likewise are linear at least along a portion of their length and extend perpendicularly outwardly of the support plate 26 in the same longitudinal direction as the leg sections 44, 46 of the left sighting member 12 and in the same parallel relationship. The shank portions 28, 30 are linear and extend in longitudinal parallel relation to their respective leg sections 44, 46 and 48, 50 along a central axis of each sighting member 12, 14 midway between each of the leg section pairs 44, 46 and 48, 50, respectively. In other words, the axis of each shank 28, 30 defines a central location of the open spaces 52, 54 midway between the inner and outer leg sections 44, 46 and 48, 50 of the left and right sighting members 12, 14.

The shank portions 28, 30 are connected to an adjacent end of the respective outer leg sections 46, 50 at a location spaced laterally from the support plate 26 by outwardly curving arcuate portions 56, 58, respectively, as shown in FIG. 3. The outer leg sections 46, 50 extend linearly from the arcuate portions 56, 58 away from the support plate 26 to opposite ends thereof which are joined to their respective inner leg sections 44, 48 by a transverse and preferably U-shaped connecting portion 60, 62. The inner leg sections 44, 48 extend from the connecting portions 60, 62 back toward the support plate 26 to distal free ends 64, 66 that are bent inwardly toward the arcuate portions 56, 58 to together provide the arcuate sections 56, 58 and their adjacent free end portions 64, 66 with generally the same U-shaped configuration as the connecting portion 60, 62, giving the sighting members 12, 14 each a generally oblong oval configuration with straight longitudinal sides formed by the leg sections 44, 46 and 48, 50 and with rounded ends provided by the connecting portions 60, 62 at an outwardmost end thereof, and the arcuate portions 56, 58 in their associated free end portions 64, 66 at the opposite end nearer to the support plate 26. The sighting members 12, 14 are preferably each constructed from a single piece of metal bar or wire stock bent into the shape above during fabrication of the members 12, 14 and are rigid and not readily bent or deformed by the user or during handling and use so as not to disturb the as-fabricated shape of the members 12, 14.

As shown in FIG. 3, the overlapping of the sighting members 12, 14 in the central image 22 provides the image 22 with the same oblong oval configuration as each of the sighting members 12, 14, including a pair of leg section images 68, 70 and a combined superimposed image of the open spaces 52, 54 providing an open target viewing window 72 between the leg section images 68, 70, as shown in FIG. 3. The left leg section image 68 is formed by the superimposition of the outer leg section 46 of the left sighting member 12 and the inner leg section 48 of the right sighting member 14, whereas the right hand leg section image 70 is formed by the superimposition of the inner leg section 44 of the left sighting member 12 and the outer leg section 50 of the right sighting member 14. The viewing window 72 is of the same oblong oval shape as the open spaces 52 and 54 of the leg sections and a lateral width corresponding to the spacing between the inner and outer leg sections 44, 46 and 48, 50 of the citing members.

The perceived width of the viewing window 72 may be adjusted, however, by adjusting the effective lateral spacing between the inner and outer leg sections 44, 46 and 48, 50, as seen by the user when viewing the target. As illustrated in FIG. 3, the inner and outer leg sections 44, 46 and 48, 50 are arranged in a common plane situated crosswise to the line of sight of the user such that the leg sections are equally spaced from the user providing a greatest width to the viewing window 72. The sighting members 12, 14 may be rotated about the longitudinal axis of the shank portions 28, 30 to move the inner and outer leg sections 44, 46 and 48, 50 seemingly nearer to one another, as perceived by the user, to effectively narrow the width of the open spaces 52, 54 and hence correspondingly narrowing the open viewing window 72, as illustrated in FIG. 5, wherein the widest width spacing of the open viewing window 72 as illustrated in FIG. 5 is shown by broken lines and the narrowingly adjusted positioning of the central image 22 is shown in solid lines producing the narrower width viewing window 72.

The mounting means 18 includes side mounting hardware extending laterally from an end of the support means 16 for mounting the support means 16 and sighting members 12, 14 to a midsection of the bow 20 with the support plate 26 projecting in cantilevered fashion laterally outwardly from a longitudinal side of the bow midsection 74 placing the sighting members 12, 14 in the foreground of the user's view of the target.

A typical bow 20 has the aforementioned rigid midsection designated generally by reference number 74 having a grip 76 adapted to be grasped by one hand of the user for supporting the midsection 74 in a generally upright longitudinally extending vertical manner when in use. A flexible upper limb 78 is secured to an upper end of the midsection 74 above the grip 76 and a lower flexible limb (not shown) is secured to a bottom end (not shown) of the midsection 74 below the grip 76 for supporting a bow string (not shown) under tension in conventional manner. Between the grip 76 and the upper limb 78, the midsection 74 has a neck region 80 of narrower width than the adjacent portions of the midsection 74 of generally rectangular transverse cross section. The neck region 80 has an inner side surface 82, and outer side surface 84 that is generally parallel to the inner side surface 82 and a front surface 86 and back surface 88 extending between the inner and outer side surfaces 82, 84. The bow in FIG. 1 is designed for a right-handed user in which the grip 76 would be grasped by the left hand of the user supporting the bow longitudinally upright as shown in FIG. 1 at full arms length off to the right side of the users head. An arrow rest 90 is mounted on the inner side surface 82 of the midsection 74 just above the grip 76 for supporting the shaft of an arrow (not shown).

The mounting means 18 projects laterally from a side of the support means 16 for mounting the support means 16 and sighting members 12, 14 to the midsection 74 of the bow with the support means 16 projecting laterally outward of the inner side surface 82 of the midsection supporting the sighting members 12, 14 in the foreground of the users view to the distant target in the aforementioned side-by-side laterally spaced relationship. A mounting means 18 includes a mounting plate or bracket 92 having one or more fasteners 94 for securing the bracket 92 to the bow midsection 74 and preferably to the outer side surface 84, as shown in FIG. 1. A portion of the mounting bracket 92 projects beyond the front surface 86 of the midsection 74 and includes an elongate longitudinal slot 96 extending lengthwise of the bow 20. Such a slotted bracket is known in the bow hunting field as a so-called "universal bracket" for mounting more conventional pin sights in virtually spaced relation to one another.

A mounting member 98 is secured at one end to the support plate 26 and projects laterally therefrom in prolongation of the support plate 26 to an opposite distal free end spaced laterally further from the sighting members 12, 14 and the connected end. The mounting member 98 is connected to the mounting bracket 92 for selective longitudinal sliding movement along the adjustment slot 96. Preferably, the mounting member 98 comprises an externally threaded fastener fastened or otherwise secured, such as by welding, at one end to a longitudinally extending L-shaped end portion or foot 102 formed preferably by bending an innermost end of the support plate 90° relative to the remaining laterally extending portion of the support plate 26. The free end 100 of the threaded fastener 98 extends through the adjustment slot 96 for enabling the fastener member 98, the support means 16, and the sighting members 12, 14 to be slid together in a longitudinal direction along the slot 96 to any of a number of positions of longitudinal adjustment. A pair of internally threaded nuts 104, 106 are disposed on the threaded fastener 98 on opposite sides of the mounting bracket 92 and may be rotated for movement laterally toward one another to clamp the mounting bracket 92 therebetween to secure the apparatus 10 in a selected position of longitudinal adjustment along the slot 96.

The mounting means 18 also includes lateral adjustment means for enabling the user to make lateral adjustment in the position of the support means 16 and sighting members 12, 14 relative to the bow midsection 74 and mounting bracket 92. The lateral adjustment means is provided by the threaded mounting fastener 98 and nuts 104, 106 which, when rotated on a threaded fastener together in one direction enable the support means 16 and sighting members 12, 14 to be advanced together laterally toward the mounting bracket 92 and likewise move readily away from the mounting bracket 92 when the nuts 104, 106 are rotated together in an opposite direction.

As shown in FIG. 1, the sighting apparatus 10 is mounted above the arrow rest 90 with the support plate 26 supported above the sighting members 12, 14, and the sighting members 12, 14 projecting laterally downwardly from the support plate 26.

In use, the user mounts the sighting members 12, 14 to the support plate 26 and makes appropriate adjustments to the lateral spacing between the sighting members 12, 14 such that the spacing between the open spaces 52, 54 approximates the lateral spacing between the users eyes. The mounting bracket 92 is secured to the bow midsection 74 and the mounting fastener 98 extended through the adjustment slot 96 of the bracket 92 and held in place by the nuts 104, 106. The sighting members 12, 14 are oriented in downwardly depending relation from the support plate 26 as in FIG. 1 and appropriate longitudinal adjustments made to the support plate 26 and sighting members 12, 14 by movement of the mounting fastener 98 along the adjustment slot 96 to position the sighting members 12, 14 generally along the users line of sight to the target T. The nuts 104, 106 are then tightened against the mounting bracket 92 to secure the support plate 26 and sighting members 12, 14 in position on the bracket 92. When properly positioned, the lateral position of the right sighting member 14 will fall along the users right eye line of sight to the target. In other words, if the user supports the bow 20 in the upright shooting position and views a distant target T, the user will be able to see the target in the open space 54 of the right sighting member 15 with his right eye when the appropriate lateral adjustments are made via the threaded mounting member 98 and nuts 104, 106. The lateral spacing between the sighting members 12, 14 may then be fine tuned by adjusting the lateral position of the left hand sighting member 12 relative to the right sighting member 14 via the slot 32 until such time as the left hand sight 12 falls along the line of sight of the users left eye to the target T. The position of the left sighting member 12 may then be maintained by tightening the nuts 40, 42 against the support plate 26. Once the sighting members 12, 14, have been properly positioned laterally relative to one another, the user perceives the central coincident image 22 of the sighting members 12, 14 when viewing the target T with both eyes open.

Appropriate longitudinal relative adjustment of the sighting members 12, 14 may also be made to compensate for head tilt or other causes of longitudinal misalignment of the users eyes (i.e., one eye being situated higher than the other) when sighting the target T. Longitudinal adjustment of the sighting members 12, 14 is accomplished by movement of the nuts 36, 38 and 40, 42 relative to the shanks 28, 30 in the manner previously described. Once positioned, the nuts 36, 38 and 40, 42 are tightened against the support plates 26 to secure the sighting members 12, 14 in position.

Distance compensation means 108 are provided for enabling the user to make appropriate adjustments in the elevational positioning of the bow to compensate for distance to target. The distance compensation means 108 includes at least a first pair of distance indicators 110*a*, 110*b* supported by the sighting members 12, 14 and moveable longitudinally relative to the sighting members 12, 14 to a selected one of a plurality of longitudinal positions corresponding to associated distances to target. As illustrated in FIG. 3, the distance indicator 110a is supported on a leg section of the left sighting member 12 and the distance indicator **110*b* is supported on a corresponding leg section of the right sighting member 14 (e.g., the inner leg sections 44, 48). The distance indicators 100*a*, 100*b* are perceived by the user in the coincident central image 22 as distance indicator images 110*a*' and 110*b*' associated with the left and right leg section images 70, 68, respectively, as illustrated in FIG. 3**.

The distance indicators **100*a*, 100*b* are provided with gripping means for gripping the leg sections 44, 48 with a frictional gripping force sufficient to normally prevent relative movement therebetween while enabling such relative movement upon application of bodily force to the distance indicator sufficient to overcome the frictional force. The gripping means comprises an opening 112 in each of the distance indicators 110*a*, 110*b* having a resilient sidewall that is relatively smaller in section than that of the leg section 44, 48 for constantly gripping the leg section with frictional gripping force. As shown best in FIG. 6, the leg sections 44, 48 are circular in section and extend through a similarly shaped but smaller diameter apertures 112 of the distance indicators 110*a*, 110*b*. The distance indicators 110*a*, 110*b* are preferably fabricated of a resilient flexible plastic material that enables the openings 112 to be enlarged somewhat upon insertion of the leg sections 44, 48 therein. As illustrated in FIGS. 1 and 3, the free ends 64, 66 of the inner leg sections 44, 48 are not joined to other portions of the sighting members 12, 14, but rather are spaced therefrom enabling the distance indicators 100*a*, 100*b* to be slid over the free ends 64, 66 extending the inner leg sections 44, 48 through the openings 112 in the distance indicators 110*a*, 110*b* to thereby mount the indicators 110*a*, 110*b* on the inner leg sections 44, 48**.

To properly position the distance indicators **110*a*, 110*b* for a given distance to target, the user positions himself at the selected distance and then fires several arrows at the target, each time making the appropriate longitudinal adjustment of the positioning of the distance indicators 110*a*, 110*b* along the inner leg sections 44, 48 until the desired accuracy is attained. As shown in FIG. 3, the distance indicators 110*a*, 110*b*, when properly positioned, are supported on the leg sections directly across from one another such that the distance indicators 110*a*, 110*b* and their associated distance indicator images 110*a*', 110*b*' lie in a common plane If the user tilts his head or rotates his wrist so as to disturb the proper relative positioning of the users head in the sighting members 12, 14 established when sighting in the bow during practice, the distance indicator images 110*a*' and 110*b*' will appear to be longitudinally misplaced and nonplanar with the distance indicators 110*a*, 110*b*, as illustrated in FIG. 4. The user may then make appropriate corrective adjustments in the relative tilt orientation between the user's head and bow, without disturbing the positions of the distance indicators on the leg sections, to bring the distance indicator images 110*a*', 110*b*' back into coplanar relation as in FIG. 3**, assuring the user that the positioning of the bow relative to the head is the same as was established in practice before firing at the target.

The distance indicators **110*a*, 110*b* each have a peripheral side edge 114, 116 spaced laterally from one another for producing a perceived open space or gap 118 between the distance indicator images 110*a*', 110*b*' defining an unobstructed sighting region therebetween for sighting the target T. The laterally spaced relationship of the distance indicator images 110*a*', 110*b*' and the leg section images 68, 70 enables the user to see the exact point on the target he wants to hit without obstruction from the sighting members themselves 12, 14**. The unobstructed view is beneficial when the target is fairly small or at a great distance and when hunting in low lighting conditions.

Means are provided for enabling the user to adjust the lateral spacing between the side edges 114 and 116. As shown best in FIG. 6, the distance indicators **110*a*, 110*b* have a teardrop shape providing eccentric lobe portions 120, 122 whose outer peripheral edge is spaced further from a central longitudinal axis of the openings 112 and the remaining portions of the indicators 110*a*, 110*b*. The distance indicators 110*a*, 110*b* are rotatable about a longitudinal axis of the inner leg sections 44, 48, respectively for extending the lobe portions 120, 122 laterally toward or away from the opposing outer leg sections 46, 50. In other words, rotating the distance indicators 110*a*, 110*b* extends the edge of the lobe portions 120, 122 more or less into the open spaces 52, 54 of the sighting members 12, 14 and hence reducing or enlarging the gap 118 perceived by the user in the central image between the distance indicator images 110*a*', 110*b*' FIG. 6 shows the lobe portions 120, 122 in the extreme extended position in solid lines for producing a very narrow gap and the least extension in broken lines producing the largest gap 118. The frictional gripping force of the walls of the aperture 112 against the leg sections 44, 48 also serve to normally maintain the indicators 110*a*, 110*b*** in a selected position of rotational adjustment, unless overcome by application of sufficient bodily force.

The distance compensation means 108 may include additional pairs of distance indicators identical in construction and function as the distance indicators **110*a*, 110*b* described above, but located at different positions of longitudinal adjustment than those of 110*a*, 110*b* corresponding to different distances to target than those of 110*a* and 110*b*. Two additional pairs are illustrated in the drawings and designated by the reference numerals 124*a*, 124*b* for the second pair, and 126*a*, 126*b*, for the third pair. The second and third distance indicator pairs 124*a*, 124*b* and 126*a*, 126*b* are supported on the inner leg sections 44, 48 and movable longitudinally there along independently of one another and of the first pair 110*a*, 110*b* to positions corresponding to different distances to target. The position of the second pair of 124*a*, 124*b* may correspond, for example, to thirty yards to target, whereas the position of the third pair, 126*a*, 126*b* may correspond, for example, to forty yards to target. The second and third distance indicator pairs 124*a*, 124*b* and 126*a*, 126*b* are of the same teardrop shape as the first distance indicator pairs 110*a*, 110*b* including eccentric lobe portions 128, 130 corresponding to the lobe portions 120, 122 of the first distance indicator pairs 110*a*, 110*b***.

Like the first distance indicator pairs **110*a*, 110*b*, the second and third distance indicator pairs 124*a*, 124*b*, and 126*a*, 126*b* are perceived in the central coincident image 22 producing corresponding second and third distance indicator pair images 124', 124*b*' and 126', 126*b*' as illustrated in FIG. 3. The second and third distance indicator pairs are rotatable about the inner leg sections 44, 48 independently of one another and of the first indicator pair 110*a*, 110*b*** for adjusting the lateral gap spacing via displacement of the lobe portions for adjusting the width of the lateral gap or unobstruction sighting region between each pair of sighting members independently of the other. As shown in FIG. 7, the rotational positions of the distance indicator pairs can be adjusted to obtain relatively wider and narrower lateral spacing between the distance indicator images of the first, second and third distance indicator pairs.

The distance indicator pairs may be color coded to enable the user to easily discern and readily recall which pair of indicators corresponds to a particular distance to target. For example, the first pair of distance indicators 110*a*, 110*b* may be of a green color, the second distance indicator pairs 124*a*, 124*b* being of an orange color, and the third distance indicator pairs 126*a*, 126*b* being of a yellow color. Other colors are, of course, contemplated but it is preferred that the chosen colors be different for each pair of distance indicators.

In use, the user positions the second and third distance indicator pairs in their appropriate longitudinal and lateral positions along the inner leg sections 44, 48 in the same manner as with the first distance indicator pairs 110*a*, 110*b*, but corresponding to different distances to target (e.g., twenty yards and forty yards). Once the positions of the sighting members 12, 14 and distance indicators are established, the user may accurately aim the bow 20 at the target T by first estimating the distance to target and then sighting the target through the open viewing window 72 of the image 22 and adjusting the elevational position of the bow by raising or lowering the users arm placing the associated image of the distance indicator pairs corresponding to that distance on opposite lateral sides of the target such that the target appears between the sighting member images in the unobstructed sighting region or gap therebetween assuring proper alignment of the arrow to the target.

The disclosed embodiment is representative of the preferred form of the invention, but is intended to be illustrative rather than definitive thereof. The invention is defined in the claims.

I claim:

1. Stereoscopic sighting apparatus, comprising:

a pair of left and right longitudinally extending sighting members;

support means for supporting said sighting members in laterally spaced side-by-side relation to one another on a member to be sighted at a distance approximating the lateral spacing between a users eyes and along a users line of sight to a distance target for generating a perceived coincident central image of said sighting members aligned with the target when the target is viewed with both eyes open; and distance compensation means movable longitudinally relative to said sighting members to at least a selected one of a plurality of longitudinal positions corresponding to associated distances to target and perceived by the user in said coincident central image for enabling the user to make appropriate elevational adjustments to the position of the member to be sighted to compensate for distance to target while maintaining the position of said sighting members relative to said support means.

2. The apparatus of claim 1 wherein said distance compensation means comprises at least one distance indicator supported by at least one of said sighting members.

3. The apparatus of claim 2 wherein said left sighting member includes at least one longitudinal leg section and said right sighting member includes at least one longitudinal leg section spaced laterally from said longitudinal leg section of said left sighting member.

4. The apparatus of claim 3 wherein said distance compensation means comprises at least a first laterally adjacent pair of said at least one distance indicator supported by said longitudinal leg sections in laterally spaced coplanar relation to one another.

5. The apparatus of claim 4 wherein said distance compensation means comprises a plurality of said distance indicator pairs.

6. The apparatus of claim 5 wherein said distance indicator pairs are movable on said leg sections independently of one another.

7. The apparatus of claim 6 wherein said distance indicator pairs are of different color.

8. The apparatus of claim 4 wherein said distance indicators are perceived in said coincident central image as distance indicator images and said distance indicators have peripheral side edges spaced laterally from one another for producing a perceived open space between the distance indicator images.

9. The apparatus of claim 8 wherein said distance indicators include space adjustment means for adjusting the lateral spacing between the peripheral side edges of the distance indicators to effectuate adjustment of the perceived open space between the distance indicator images.

10. The apparatus of claim 9 wherein said space adjustment means comprises eccentric lobe portions provided on each of said distance indicators projecting laterally of said leg sections, said distance indicators being supported for rotation about a longitudinal axis of said leg sections that is eccentric with respect to said lobe sections for adjusting said relative spacing between adjacent side edges and said perceived space between said distance indicator images on rotation of said distance indicators.

11. The apparatus of claim 4 wherein said distance indicators have gripping means for gripping said leg sections with frictional gripping force sufficient to normally prevent relative movement therebetween while enabling said relative movement upon application of bodily force to said distance indicators sufficient to overcome said frictional force.

12. The apparatus of claim 11 wherein said gripping means comprises an opening in each of said distance indicators having a resilient sidewall relatively smaller in section than that of said associated leg section for gripping said leg section with said frictional gripping force.

13. The apparatus of claim 4 wherein each of said sighting members includes a pair of longitudinally extending leg sections spaced laterally from one another, said leg section pairs being superimposed upon one another and said coincident central image producing a corresponding single pair of laterally spaced leg section images providing an open target viewing window therebetween, one distance indicator of said pair of distance indicators being supported on one of said leg sections of said left sighting member and the other distance indicator of said pair of distance indicators being supported on one of said leg sections of said right sighting member for producing a perceived image of said pair of distance indicators extending from said leg section images laterally toward one another into said open viewing window.

14. The apparatus of claim 13 wherein said left and right sighting members include means for adjusting the lateral spacing between said leg sections of each pair of said key sections.

15. The apparatus of claim 14 wherein said left and right sighting members are each supported for selective rotation about respective longitudinal axes relative to said support means for adjusting the effective spacing of said leg sections as seen by the user to thereby adjust the width of the perceived open target viewing window of said central image.

16. The apparatus of claim 15 wherein said left and right sighting members include connecting portions interconnecting each pair of said leg sections, said left and right sighting members having identical open loop configurations.

17. The apparatus of claim 15 wherein said pairs of leg sections are parallel.

18. The apparatus of claim 4 including longitudinal adjustment means for enabling longitudinal adjustment of said sighting members relative to one another.

19. The apparatus of claim 3 including lateral adjustment means for adjusting a lateral spacing between said sighting members.

20. The apparatus of claim 1 including side mounting means secured to said support means and projecting laterally away from said longitudinally extending sighting members and laterally outward of said support means for mounting said apparatus in laterally outward extending relation to a longitudinal midsection of a bow.

21. The apparatus of claim 20 wherein said side mounting means includes lateral adjustment means for enabling lateral adjustments in position of said apparatus relative to the bow.

22. The apparatus of claim 21 wherein said mounting means comprises a mounting member secured to said support means at one end thereof and extending laterally to an opposite free end spaced from said support means, said mounting means further including a mounting bracket having means for securing said bracket to the bow midsection an a longitudinally extending slot in said mounting bracket slidably supporting said mounting member for enabling longitudinal movements of said support means and said sighting members along said slot relative to said mounting bracket, and releasable securing means acting between said mounting member and said mounting bracket for releasably securing said apparatus in a selected one of a plurality of longitudinal positions relative to said mounting bracket.

23. The apparatus of claim 1 wherein said sighting members each have identical open loop configurations producing an open viewing window in said central coincident image of said sighting members.

24. Stereoscopic sighting apparatus, comprising:

a support member;

a pair of left and right sighting members of substantially identical open loop configuration each including inner and outer leg sections extending transversely of said support member in laterally spaced relation providing respective open spaces therebetween, said sighting members being supported by said support member in laterally spaced side-by-side relation to one another, a central distance between said open spaces approximating the spacing between a users eyes such that when the user positions said sighting members along a line of sight to a distant target, the sighting members generate a perceived coincident central image of said sighting members aligned with the target when the target is viewed with both eyes open and including a single pair of laterally spaced leg section images providing an open space target viewing window therebetween; and including at least a first pair of distance indicators supported in laterally spaced relation on said left and right sighting members, respectively, by associated ones of said inner and outer leg sections and perceived in said coincident central image as distance indicator images supported in side-by-side coplanar relation by said leg section images having adjacent side edges extending beyond said leg section images into said target viewing window and spaced laterally from one another defining an unobstructed sighting region therebetween for sighting the target.

25. The apparatus of claim 24 including a plurality of said distance indicator pairs supported in adjacent longitudinal positions corresponding to associated distances to target.

26. The apparatus of claim 25 wherein said distance indicator pairs are movable longitudinally relative to one another.

27. The apparatus of claim 26 wherein said distance indicator pairs are supported for selective rotation on said leg sections and include eccentric lobe portions for adjusting the lateral spacing between said distance indicator images on rotation of said distance indicators on said leg sections.

28. The apparatus of claim 24 wherein said sighting members are supported for selective rotation relative to said support means about longitudinal axes of said sighting members for adjusting the perceived width of said target viewing window.

29. The apparatus of claim 24 wherein said inner and outer leg sections are parallel.

* * * * *